US009444181B2

(12) United States Patent
Ishihara et al.

(10) Patent No.: US 9,444,181 B2
(45) Date of Patent: Sep. 13, 2016

(54) RECEPTACLE HAVING A PLATE-LIKE MEMBER FOR RECEIVING A PLUG HAVING A PLATE-LIKE MEMBER

(71) Applicant: LENOVO (SINGAPORE) PTE. LTD., Singapore (SG)

(72) Inventors: Yoshihisa Ishihara, Kanagawa-ken (JP); Takehito Yamauchi, Kanagawa-ken (JP); Masayuki Amano, Kanagawa-ken (JP); Takayuki Suzuki, Tokyo (JP)

(73) Assignee: LENOVO (SINGAPORE) PTD LTE, Singapore (SG)

( * ) Notice: Subject to any disclaimer, the term of this patent is extended or adjusted under 35 U.S.C. 154(b) by 0 days.

(21) Appl. No.: 14/568,416

(22) Filed: Dec. 12, 2014

(65) Prior Publication Data

US 2015/0180184 A1 Jun. 25, 2015

(30) Foreign Application Priority Data

Dec. 20, 2013 (JP) ..... 2013/264218

(51) Int. Cl.
*H01R 13/62* (2006.01)
*H01R 13/60* (2006.01)

(52) U.S. Cl.
CPC ..... *H01R 13/60* (2013.01)

(58) Field of Classification Search
CPC ..... H01R 13/62938; H01R 13/635
USPC ..... 439/159, 152–157, 160
See application file for complete search history.

(56) References Cited

U.S. PATENT DOCUMENTS 5,634,802 A 6/1997 Kerklaan
5,773,332 A 6/1998 Glad
6,641,441 B2 * 11/2003 Liu ..... G06K 7/0013 439/630
7,537,486 B2 * 5/2009 Hong ..... G06K 7/0021 439/153
7,544,097 B2 * 6/2009 Hong ..... G06K 13/0862 439/157
7,568,928 B2 * 8/2009 Hou ..... H01R 13/2442 439/188
8,100,722 B2 * 1/2012 Hu ..... G06K 7/0021 439/352
8,740,635 B2 * 6/2014 Lim ..... G06K 13/08 439/159
2005/0070138 A1 3/2005 Chiou et al.

FOREIGN PATENT DOCUMENTS

JP 08-069841 3/1996
JP 08-293013 11/1996
JP 08/293013 11/1996
JP 3098622 10/2003
JP 2006-020161 1/2006
JP 3179433 10/2012

* cited by examiner

*Primary Examiner* — Phuongchi T Nguyen
(74) *Attorney, Agent, or Firm* — Antony P. Ng; Russell Ng PLLC

(57) ABSTRACT

An electronic apparatus includes a receptacle for connecting to a plug is disclosed. The receptacle is located on an outer surface of a chassis of the electronic apparatus. The plug includes a male-side plate-like member having a signal terminal disposed therein is contained in a metal case. The receptacle includes a female-side plate-like member having a signal terminal disposed therein. The female-side plate-like member is configured to protrude from or retreat into the outer surface of the chassis. The plug is connected to the female-side plate-like member at a protruding position at which the female-side plate-like member protrudes from the outer surface of the chassis.

20 Claims, 7 Drawing Sheets

RECEPTACLE HAVING A PLATE-LIKE MEMBER FOR RECEIVING A PLUG HAVING A PLATE-LIKE MEMBER

PRIORITY CLAIM

The present application claims benefit of priority under 35 U.S.C. §§120, 365 to the previously filed Japanese Patent Application No. JP2013-264218 with a priority date of Dec. 20, 2013, which is incorporated by reference herein.

BACKGROUND OF THE INVENTION

1. Technical Field

The present invention relates to receptacles in general, and particularly to a receptacle having a female-side plate-like member for receiving a plug having a Male-side plate-like member.

2. Description of Related Art

Various electronic devices such as a personal computer are provided with a receptacle based on a universal serial bus (USB) standard for connection to peripherals or the like.

USB connectors are classified into an A type disposed on a personal computer side and a B type disposed on a peripheral side. A receptacle of a USB-A standard is assembled into an opening formed on an outer surface of a chassis of a personal computer, and a plug connected thereto is attached to an end of an apparatus such as a cable or a flash memory. The receptacle has a configuration in which a plate-like member (female-side plate-like member) having a signal terminal disposed therein is installed in the opening of the chassis, the plug has a configuration in which a plate-like member (male-side plate-like member) having a signal terminal disposed therein is received in a metal case, and the signal terminals are connected to each other by inserting the metal case of the plug into the receptacle.

Such USB connectors are generally classified into a standard (regular) type connector having been widely used and a micro type connector obtained by reducing the size of the standard type connector. The standard type connector has a merit that there is a lot of corresponding apparatuses and thus universality thereof is high, but the outer shape has a certain degree of size and, for example, the height of the receptacle is about 6.2 mm. Accordingly, when a standard type receptacle is mounted on a chassis of an electronic devices, restrictions to chassis design increase to secure the size of an opening. For example, in a chassis having a curved cross-section in which the thickness of the side of the chassis is smaller than that of the central portion thereof, there is demand for a design in which only the thickness of the opening of the receptacle is greater than those of the other parts. The demand for the decrease in thickness of a chassis becomes more marked for portable electronic apparatuses such as a laptop personal computer (laptop PC), a tablet personal computer (tablet PC), and a smart phone.

For the decrease in thickness of a USB connector, for example, a configuration in which the outer metal case is removed and the male-side plate-like member having a signal terminal disposed therein is exposed to the outside has been proposed to achieve the decrease in thickness of the plug.

However, there is no proposal for a decrease in thickness of a receptacle for achieving a decrease in thickness of a terminal-side chassis of a laptop PC, a tablet PC, or the like. Thus, there is demand for a structure capable of securing a degree of freedom in design of a chassis by decreasing the thickness of a standard type receptacle that is used for more apparatuses and has a high universality. When the thickness of a micro type receptacle decreases, it is possible to further enhance the degree of freedom in design of a chassis.

SUMMARY OF THE INVENTION

In accordance with a preferred embodiment of the present invention, a receptacle includes a female-side plate-like member having a signal terminal disposed therein and a slider. The slider can be used to control the positioning of the female-side plate-like member in relation to an outer surface of a chassis of an electronic device in which the receptacle is installed. The female-side plate-like member is positioned to protrude from the outer surface of the chassis when it is ready to receive a plug having a male-side plate-like member on which a signal terminal is disposed. The female-side plate-like member is positioned to conceal from the outer surface of the chassis when it is not ready to receive the plug.

All features and advantages of the present disclosure will become apparent in the following detailed written description.

BRIEF DESCRIPTION OF THE DRAWINGS

The disclosure itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
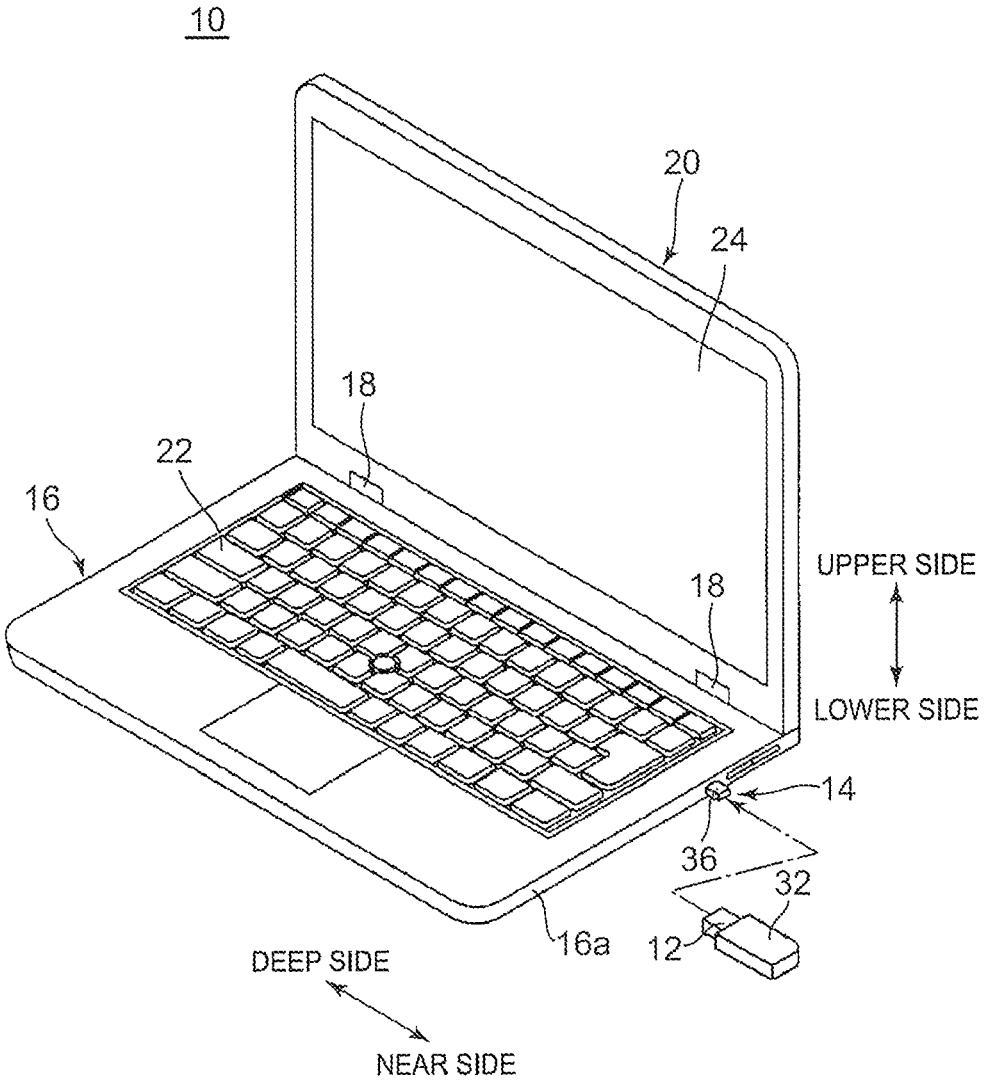
FIG. 1 is a perspective view of an electronic apparatus in which a preferred embodiment of the present invention can be incorporated.

FIG. 1 is a perspective view of an electronic apparatus 10 in which a preferred embodiment of the present invention can be incorporated. The electronic apparatus 10 is a laptop PC having a receptacle 14, which is used for a connection standard for a plug 12 attached to a cable connected to various peripherals or an end of a device such as a flash memory, on a lateral surface of a chassis 16. Examples of the electronic apparatus 10 include various electronic apparatuses such as a tablet PC and a smart phone in addition to the laptop PC.

The connection standard between the plug 12 and the receptacle 14 in this embodiment is a USB-A standard (standard-A) of a standard type (regular type) which has been widely used, and is based on a USB 2.0 communication standard. The invention may be used to, for example, a USB-B standard (standard-B) of a standard type, a micro USB-A it or USB-B standard (micro-A or micro-B), and a USB 3.0 communication standard, in addition to the USB-A standard of a standard type.

The electronic apparatus 10 on which the receptacle 14 according to this embodiment is mounted is a laptop PC including a chassis 16 as a base and a cover 20 connected to the chassis 16 so as to be opened and closed via a hinge 18. A keyboard 22 is disposed on the top surface of the chassis 16 and a display device 24 including a liquid crystal display or the like is disposed on the inner surface of the cover 20.

In the description below, as illustrated in FIG. 1, a head side in a direction in which the plug 12 is connected to the receptacle 14 is defined as a deep side (front side), a tail side therein is defined as a near side (rear side), and the thickness direction of the chassis 16 is defined as an up-down direction (upper side, lower side).

Figure 2:
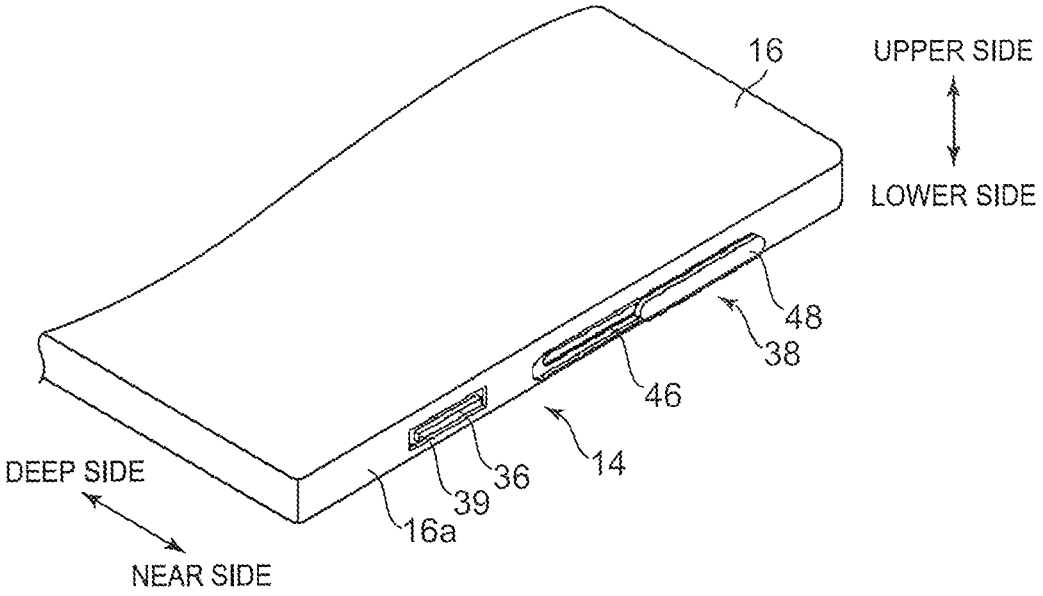
FIG. 2 is a perspective view of a receptacle and a periphery thereof when viewed from the upper side.
Figure 3:
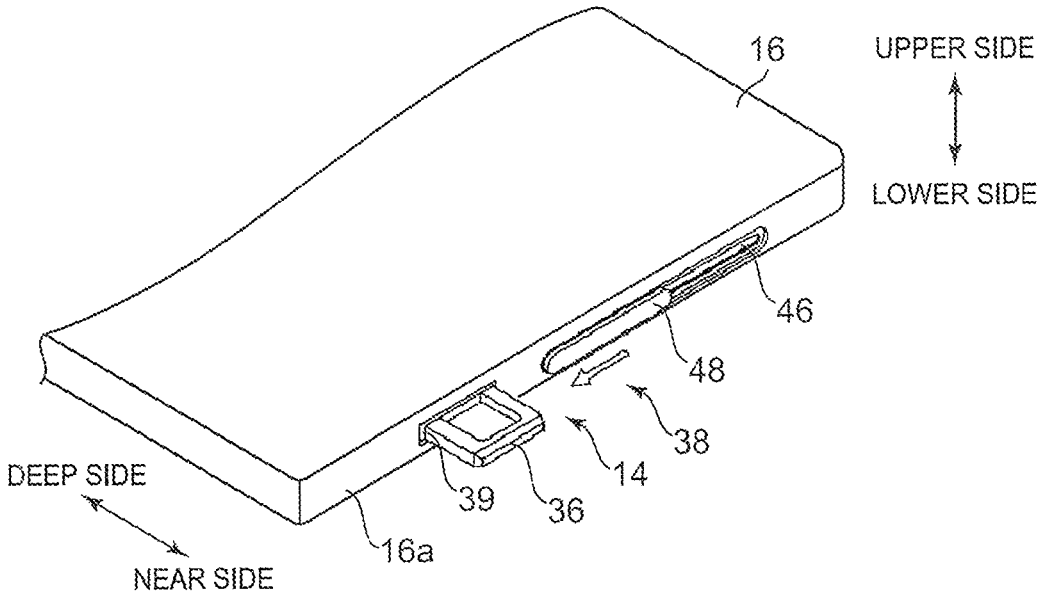
FIG. 3 is a perspective view showing a state where a female-side plate-like member protrudes to a protruding position from the state illustrated in FIG. 2.
Figure 4:
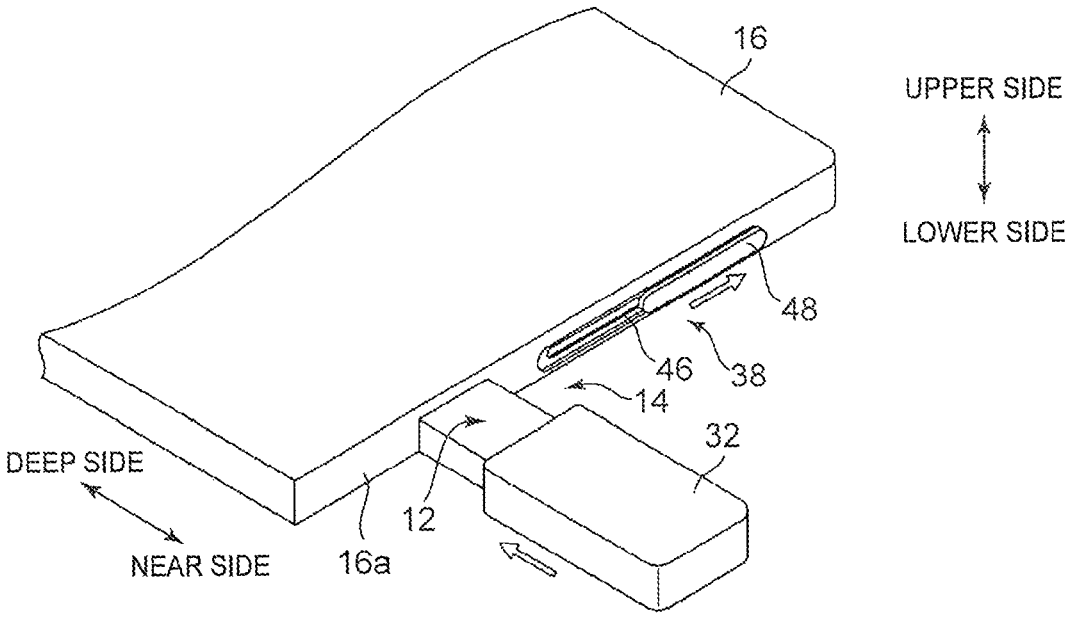
FIG. 4 is a perspective view showing a state where a plug is connected to the receptacle illustrated in FIG. 3.
Figure 5:
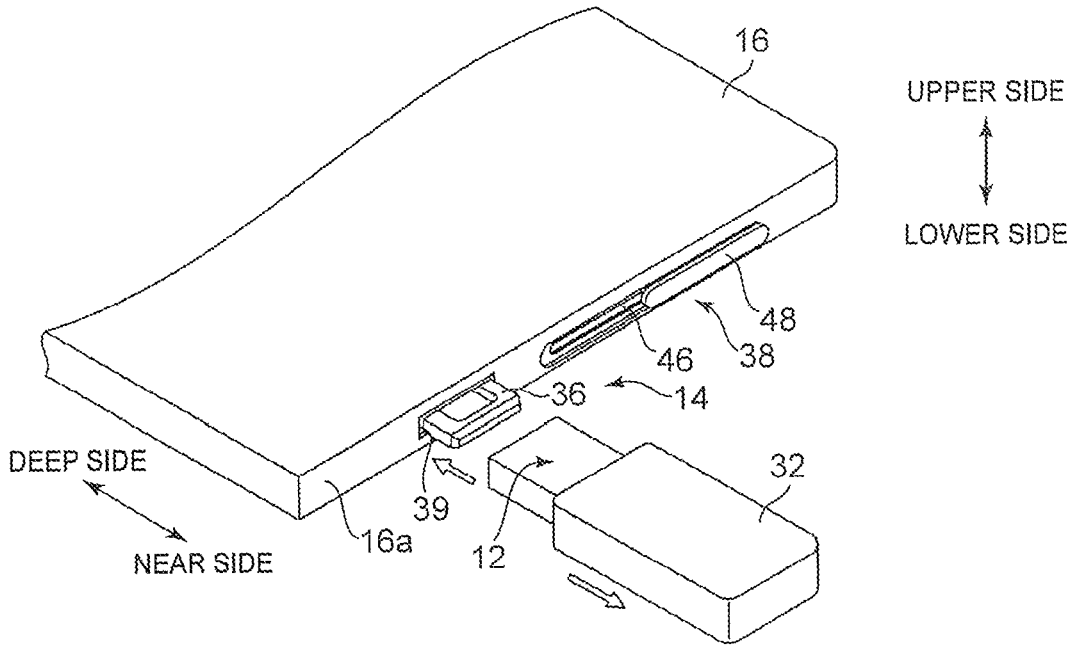
FIG. 5 is a perspective view showing a state where the plug is detached from the receptacle illustrated in FIG. 4.

FIG. 2 is a perspective view of the receptacle 14 and the periphery thereof when viewed from the upper side and illustrates a state where the female-side plate-like member 36 of the receptacle 14 is located at a sinking position. FIG. 3 is a perspective view illustrating a state where the female-side plate-like member 36 protrudes to a protruding position from the state illustrated in FIG. 2. FIG. 4 is a perspective view illustrating a state where the plug 12 is connected to the receptacle 14 illustrated in FIG. 3. FIG. 5 is a perspective view illustrating a state where the plug 12 is detached from the receptacle 14 illustrated in FIG. 4.

Figure 6A:
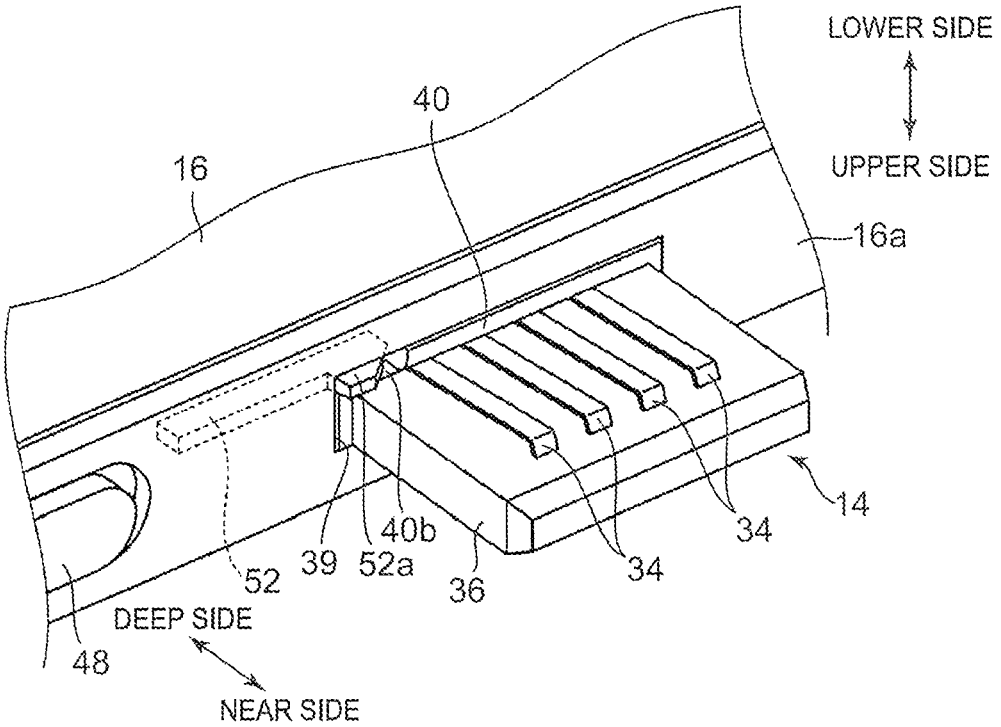
FIG. 6A is a diagram illustrating a locked state of the female-side plate-like member.
Figure 6B:
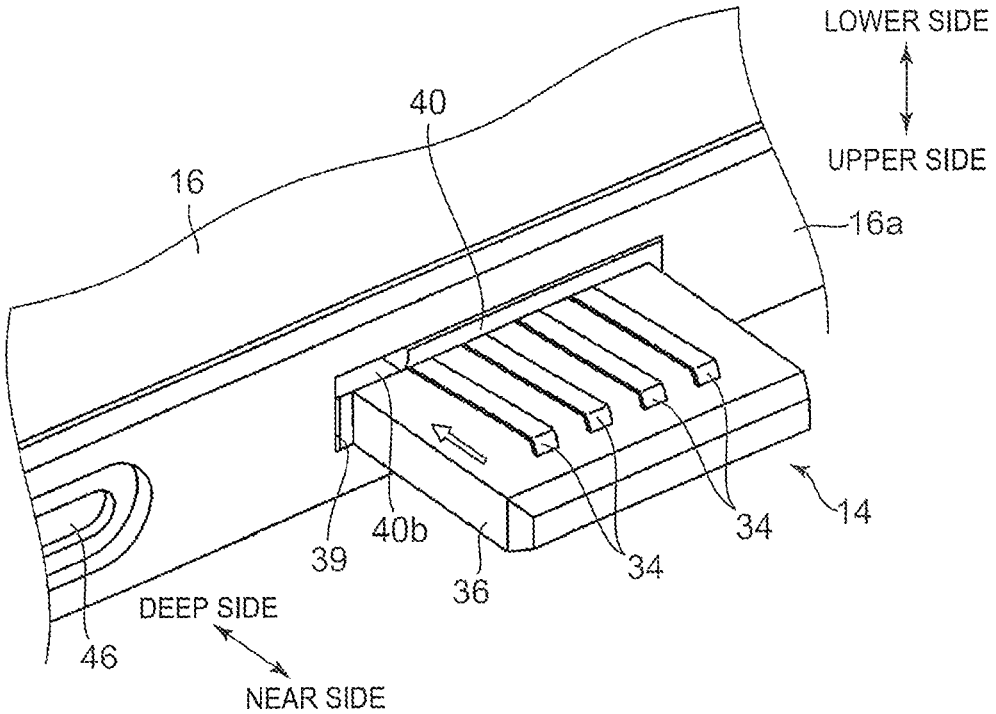
FIG. 6B is a diagram illustrating an unlocked state of the female-side plate-like member.

FIGS. 6A and 6B are enlarged perspective views of the receptacle 14 and the periphery thereof when viewed from the lower side. FIG. 6A is a diagram illustrating a locked state of the female-side plate-like member 36. FIG. 6B is a diagram illustrating an unlocked state of the female-side plate-like member 36. In FIGS. 2 to 5, the keyboard 22 disposed on the top surface of the chassis 16 is not illustrated.

The plug 12 has a structure (see FIGS. 5A and 8B) in which a male-side plate-like member 28 having four signal terminals 26 disposed is received in a metal case 30, and is a male-side connector of a general USB-A standard. In this embodiment, a memory device (USB memory) having a structure in which the plug 12 is formed at one end of a body 32 having a flash memory built therein so as to protrude therefrom is used as an example of a device including the plug 12 (see FIGS. 1 and 5).

The receptacle 14 is a female-side connector of a USB-A standard including a female-side plate-like member 36 having four signal terminals 34 disposed therein and a sliding mechanism 38 causing the female-side plate-like member 36 to protrude and sink from and into the outer surface 16*a* of the chassis 16, as illustrated in FIGS. 2 to 6B.

Figure 8A:
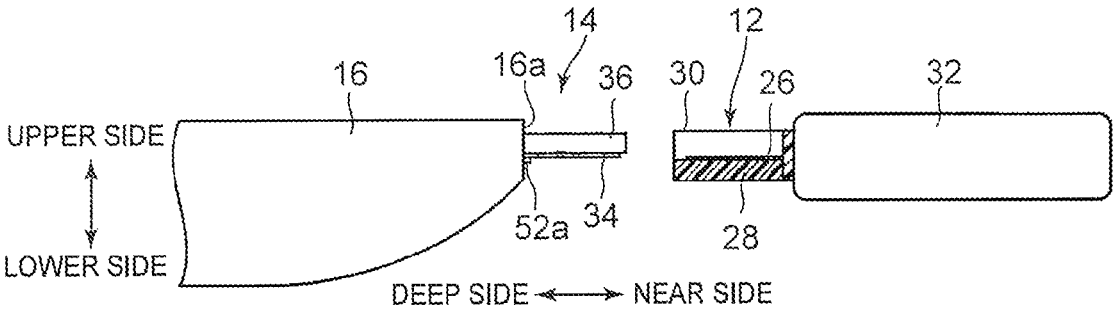
FIG. 8A is a diagram illustrating a non-connected state.
Figure 8B:
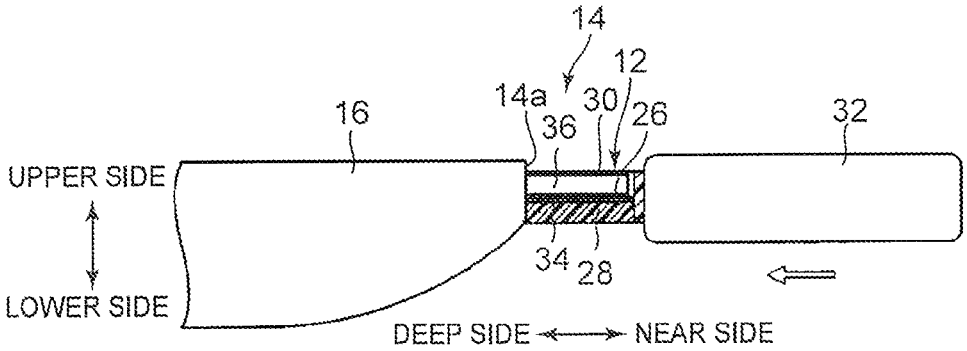
FIG. 8B is a diagram illustrating a connected state.

The female-side plate-like member 36 is a portion that electrically and mechanically connects the receptacle 14 and the plug 12 to each other by bringing the signal terminals 34 disposed on the bottom surface thereof into contact with the signal terminals 26 disposed on the top surface of the male-side plate-like member 28 when the metal case 30 of the plug 12 is externally inserted into the female-side plate-like member 36 (see FIG. 8B). The female-side plate-like member 36 can protrude and sink from and into an opening 39 formed on the outer surface 16*a* of the chassis 16 through the use of a sliding mechanism 38.

Figure 7A:
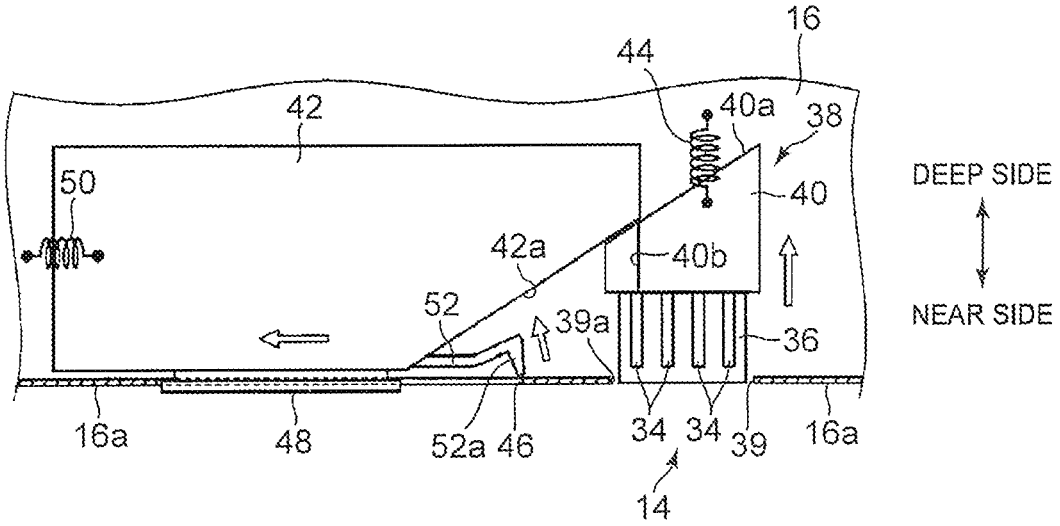
FIG. 7A is a diagram illustrating a state where the female-side plate-like member is located at a sinking position.
Figure 7B:
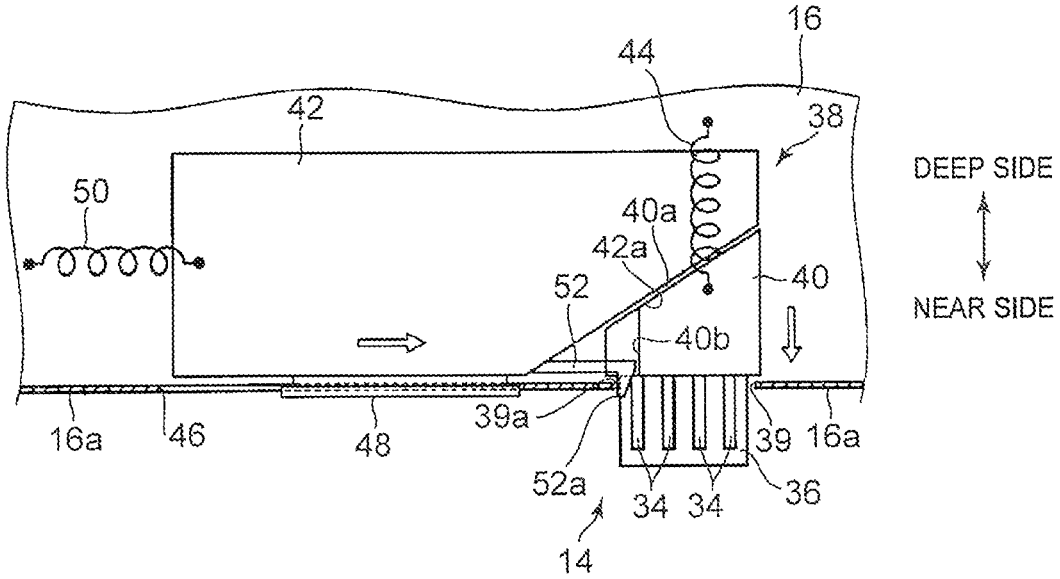
FIG. 7B is a diagram illustrating a state where the female-side plate-like member is located at a protruding position.

FIGS. 7A and 7B are cross-sectional views of the bottom of the chassis 16 illustrating a configuration example of the receptacle 14. FIG. 7A is a diagram illustrating a state where the female-side plate-like member 36 is located at a sinking position. FIG. 7B is a diagram illustrating a state where the female-side plate-like member 36 is located at a protruding position.

As illustrated in FIGS. 7A and 7B, the sliding mechanism 38 is integrated with a deep-side end surface of the female-side plate-like member 36, and includes a pressed member 40 having an inclined surface 40*a* at the tip thereof and a pressing member 42 extending in a direction parallel to the outer surface 16*a* of the chassis 16 and having an inclined surface 42*a*, which comes in sliding contact with the inclined surface 40*a* of the pressed member 40, at the tip thereof.

The pressed member 40 is a plate-like member having a thickness slightly greater than that of the female-side plate-like member 36 (see FIGS. 6A and 6B) and the inclined surface 40*a* is gradually inclined to the deep side in a direction from the pressing member 42 to a side spaced away from the pressing member 42. One end of a tension spring (elastic member) 44 of which the other end is fixed to the chassis 16 is fixed to the pressed member 40. The pressed member 40 can move forward and backward in a direction perpendicular to the outer surface 16*a* under the guidance of a guide member not illustrated while being normally impelled to the deep side by the tension spring 44.

The pressing member 42 is a plate-like member having a thickness equal to that of the pressed member 40 and the inclined surface 42*a* is gradually inclined to the deep side in a direction toward the pressed member 40. An operation member 48 exposed from a longitudinal hole 46 opened to the outer surface 16*a* is disposed on the end surface of the pressing member 42 on the outer surface 16*a* side. One end of a tension spring (elastic member) 50 of which the other end is fixed to the chassis 16 is fixed to the pressing member 42. The pressing member 42 can move forward and backward in the direction parallel to the outer surface 16*a* under the guidance of a guide member not illustrated while being normally impelled to the side spaced away from the pressed member 40 by the tension spring 50. The tension spring 50 may be skipped.

The pressing member 42 is further provided with a locking member 52 of a leaf spring shape having a hook 52*a* protruding forward at the tip thereof. The base end, which is opposite to the hook 52*a*, of the locking member 52 is fixed to the inclined surface 42*a* on the tip side of the pressing member 42 or the vicinity thereof, and the locking member 52 moves forward and backward in the direction parallel to the outer surface 16*a* along with the pressing member 42. When the pressing member 42 moves forward to the pressed member 40 side against the impelling force of the tension spring 50, the hook 52*a* goes into the opening 39 and the tip thereof protrudes to the near side from the outer surface 16*a*. Accordingly, since the inner surface of the hook 52*a* is hooked to the edge of the opening 39 (see FIGS. 6A and 7B), the pressing member 42 is locked to the forward-moved position illustrated in FIG. 7B against the impelling force of the tension spring 50. At this time, in order to cause the hook 52*a* to smoothly protrude from the opening 39, a concave relief portion 40*b* through which the hook 52*a* passes is formed on the bottom side of the pressed member 40 (see FIGS. 6A and 6B).

On the other hand, when the hook 52*a* hooked to the edge of the opening 39 is pressed to the deep side, the locking member 52 is bent to the deep side and the hooking of the book 52*a* to the edge of the opening 39 is released (see FIG. 6B). Accordingly, the hook 52*a* is received in the outer surface 16*a* and the pressing member 42 moves backward to the side spaced away from the pressed member 40 against the impelling force of the tension spring 50 (see FIG. 7A). Here, an inclined surface 39*a* is formed in one edge of the opening 39 to which the hook 52*a* is hooked in the chassis 16. Accordingly, since the hook 52*a* pressed to the deep side slides over the inclined surface 39*a* and moves backward to the deep side, the locked state based on the hook 52*a* of the locking member 52 can be smoothly released. The inclined surface 39*a* may be skipped.

In the receptacle 14 having the above-mentioned configuration, as illustrated in FIGS. 2 and 7A, when the plug 12 is connected to the receptacle 14 in a state where the female-side plate-like member 36 is located at the sinking position at which the female-side plate-like member 36 is received in the opening 39, the operation member 48 is made to slide with a finger tip and the pressing member 42 is made to move forward against the impelling force of the tension spring 50. Then, the inclined surface 42*a* of the pressing member 42 presses the inclined surface 40*a* of the pressed member 40 while coming in contact therewith, the pressed member 40 moves forward against the impelling force of the tension spring 44 as illustrated in FIGS. 3 and 7B, and the female-side plate-like member 36 is located at the protruding position at which the female-side plate-like member 36 protrudes out from the opening 39. At the same time, since the hook 52*a* of the locking is member 52 is hooked to the edge of the opening 39 (see FIGS. 6A and 7B), the pressing member 42 and the pressed member 40 are held at the forward-moved position and the female-side plate-like member 36 is locked to the protruding position.

Subsequently, as illustrated in FIGS. 4 and 8B, by externally inserting the metal case 30 of the plug 12 into the female-side plate-like member 36 and bringing the signal terminals 26 and 34 into contact with each other, the plug 12 and the receptacle 14 are connected to each other. At the same time as this connecting operation, the hook 52*a* of the locking member 52 protruding from the opening 39 is pressed to the deep side by the tip face of the metal case 30 of the plug 12. Accordingly, the pressing member 42 to which the locking of the locking member 52 is released moves backward with the impelling force of the tension spring 50 and returns to the position illustrated in FIG. 7A (see FIG. 4). At this time, the female-side plate-like member 36 is inserted into the metal case 30 of the plug 12, and the female-side plate-like member 36 is held by the plug 12 and is kept at the protruding position by the friction of the connection. That is, the female-side plate-like member 36 and the pressed member 40 are kept at the forward-moved position against the impelling force of the tension spring 44, and the connected state of the receptacle 14 and the plug 12 is maintained.

Subsequently, as illustrated in FIG. 5, the plug 12 is pulled out from the female-side plate-like member 36 to the near side to release the connected state of the plug 12 and the receptacle 14. Then, the pressed member 40 moves backward with the impelling force of the tension spring 44, the female-side plate-like member 36 is drawn into the opening 39, and returns to the sinking position illustrated in FIGS. 2 and 7A.

The configuration is described above in which the female-side plate-like member 36 is made to protrude and sink from and into the outer surface of the chassis 16 through the use of the sliding mechanism 38 that includes the pressed member 40 integrally formed with the female-side plate-like member 36 and the pressing member 42 pressing the pressed member 40 to move forward and backward, but the mechanism for causing the female-side plate-like member 36 to protrude and sink may have a configuration other than the sliding mechanism 38.

Figure 9C:
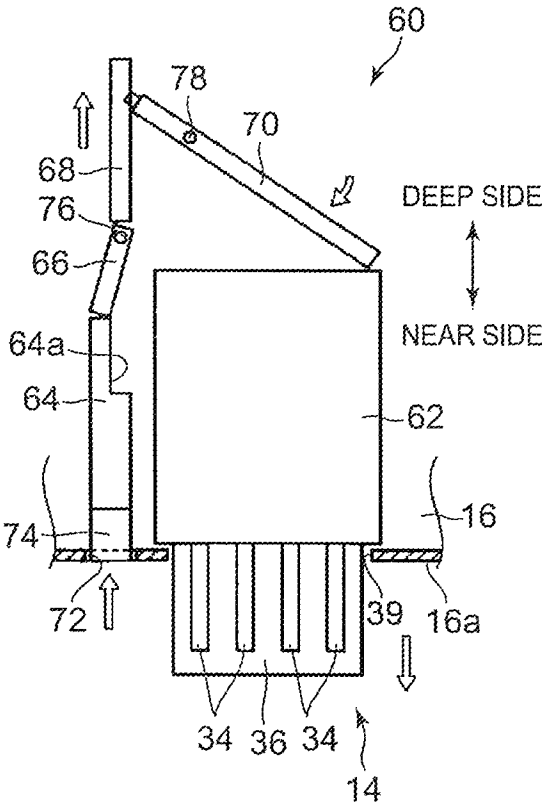
FIGS. 9A-9C are cross-sectional views of the bottom of the chassis illustrating a configuration example of a receptacle having a sliding mechanism according to a modified example.
Figure 9B:
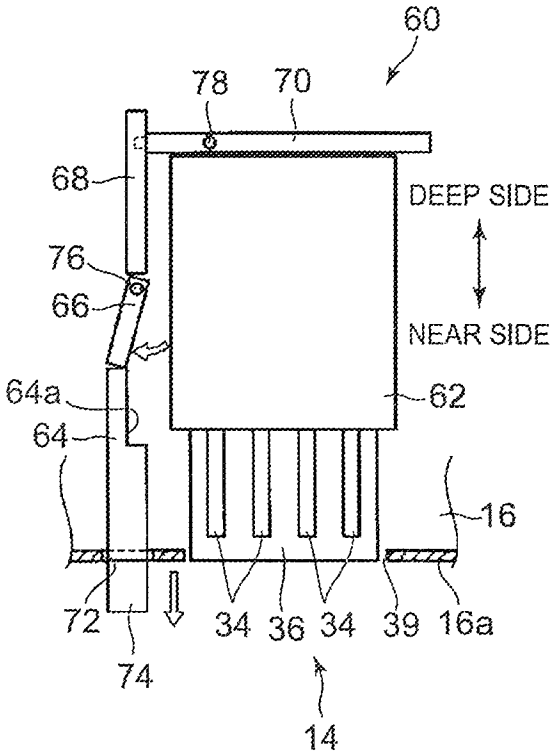
Figure 9A:
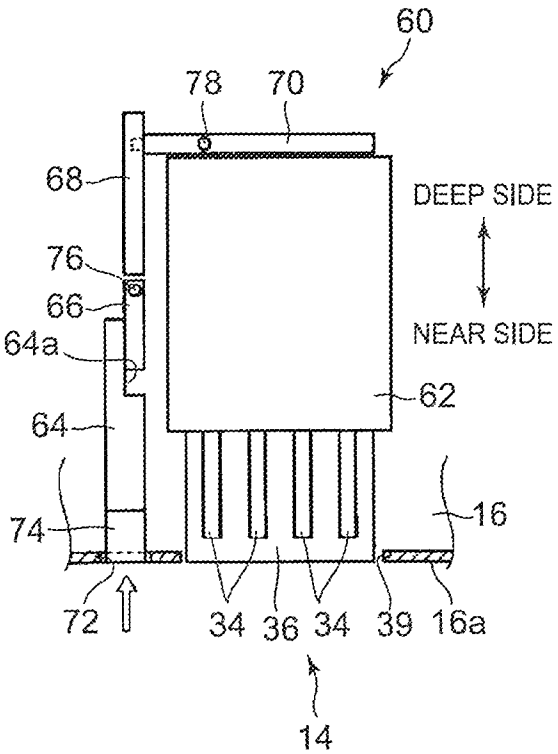

For example, a bottom cross-sectional view of the chassis 16, which illustrates a configuration example of the receptacle 14 including a sliding mechanism 60 according to a modification example, is illustrated in FIGS. 9A to 9C.

As illustrated in FIGS. 9A to 9C, the sliding mechanism 60 includes a pressed member 62 integrally formed with the deep-side end face of the female-side plate-like member 36, an ejector 64 causing the pressed member 62 to move forward and backward, an intermediate bar 66, an ejector bar 68, and a plate 70.

The pressed member 62 is a rectangular plate-like member with a thickness equivalent to that of the pressed member 40 and moves forward and backward in a direction perpendicular to the outer surface 16*a* to cause the female-side plate-like member 36 to protrude and sink from and into the opening 39 of the outer surface 16*a* under the guidance of a guide member not illustrated.

The ejector 64, the intermediate bar 66, the ejector bar 68, and the plate 70 have configurations equal or similar to the known configurations generally used in the related art as an ejector mechanism of a PC card slot which is widely mounted on laptop PCs and the like.

That is, the ejector 64 is inserted into an opening 72 formed on the outer surface 16*a* adjacent to the opening 39 and is configured to move forward and backward in the direction perpendicular to the outer surface 16*a* under the guidance of a guide member not illustrated. The tip of the ejector 64 is provided with a push-button portion (operation member) 74, and a small-width portion 64*a* disposed to be adjacent to the intermediate bar 66 is disposed on the deep side. The intermediate bar 66 is pivotally supported to be rotatable about a pivot portion 76 movably engaging with a longitudinal hole (not illustrated) of the chassis 16. The ejector bar 68 can move forward and backward in the same direction as the ejector 64 moves. The plate (pressing member) 70 is pivotally supported to be rotatable about a spindle 76 relative to the chassis 16, one end thereof engages with a hole portion formed in the ejector bar 68, and the other end serves as a pressing portion pressing the deep-side end face of the pressed member 62.

Accordingly, in the receptacle 14 having the sliding mechanism 60, when the plug 12 is connected to the receptacle 14 in a state where the female-side plate-like member 36 is located at the sinking position at which, the female-side plate-like member 36 is received in the opening 39 as illustrated in FIG. 9A, the ejector 64 is made to protrude to the near side as illustrated in FIG. 9B by slightly pushing the push-button portion 74 with a finger against the impelling force of an elastic member not illustrated and then detaching the finger. Accordingly, the intermediate bar 66 departs from the small-width portion 64*a* of the ejector 64 and pivots about the pivot portion 76 with the impelling force of an elastic member not illustrated, and the near-side end face thereof comes in contact with the deep-side end face of the ejector 64.

Then, when the push-button portion 74 protruding forward is pressed to the deep side and is pushed into the opening 72 as illustrated in FIG. 9C, the intermediate bar 66 moves to the deep side along with the ejector 64 and thus the ejector bar 68 also moves to the deep side. Accordingly, the plate 70 of which one end engages with the ejector bar 68 rotates about the spindle 78, the pressed member 62 moves forward with the pressing by the other end (pressing portion) of the plate 70, and the female-side plate-like member 36 is located at the protruding position at which the female-side plate-like member 36 protrudes outward from the opening 39. Accordingly, by connecting the plug 12 to the female-side plate-like member 36 located at the protruding position illustrated in FIG. 9C, the connection of the plug 12 to the receptacle 14 is completed. When the plug 12 is pulled out of the female-side plate-like member 36 to release the connected state of the plug 12 and the receptacle 14 and the female-side plate-like member 36 is pressed to move backward or the pressed member 62 is made to move with a delay by the impelling force of an elastic member not illustrated, the female-side plate-like member 36 is drawn into the opening 39 and returns to the sinking position illustrated in FIG. 9A.

In this way, in the sliding mechanism 60, the female-side plate-like member 36 can be made to protrude and sink from and into the outer surface 16*a* of the chassis 16 by pushing the push-button portion 74 of the ejector 64 moving forward and backward in the protruding and sinking direction of the female-side plate-like member 36. Accordingly, similarly to the operation member 48 of the sliding mechanism 38, it is not necessary to secure a certain degree of sliding space in the outer surface 16*a* of the chassis 16 and it is possible to secure the protruding and sinking operation of the female-side plate-like member 36 in the receptacle 14 without depending on the chassis 16.

As described above, the receptacle 14 according to this embodiment is used for a connection standard for the plug 12 in which the male-side plate-like member 28 having the signal terminals 26 disposed therein is received in the metal case 30 and includes the female-side plate-like member 36 having the signal terminals 34 disposed therein, the female-side plate-like member 36 is configured to protrude and sink from and into the outer surface 16*a* of the chassis 16 of the electronic apparatus 10 having the receptacle 14 installed therein, and the plug 12 is connected to the receptacle 14 at a protruding position at which the female-side plate-like member 36 protrudes from the outer surface 16*a* of the chassis 16. The electronic apparatus 10 according to this embodiment has the receptacle 14, which is used for the connection standard for the plug 12 in which the male-side plate-like member 28 having the signal terminals 26 disposed therein is received in the metal case 30, on the outer surface 16*a* of the chassis 16.

In this way, by employing the configuration in which the female-side plate-like member 36 of the receptacle 14 can protrude and sink from and into the outer surface 16*a* of the chassis 16 and the plug 12 is connected to the receptacle 14 at the protruding position, it is possible to obtain the connection standard for the plug 12 by only providing the chassis 16 side with a thin opening 39 having a thickness corresponding to the thickness of the female-side plate-like member 36. Accordingly, since it is not necessary to provide the chassis 16 side with an opening having an outer shape into which the metal case 30 of the plug 12 can be inserted, it is possible to decrease the thickness of the structure of the receptacle 14, to decrease the thickness of the chassis 16 of the electronic apparatus 10 on which the receptacle 14 is mounted, and to secure a degree of freedom in design of the chassis 16. The opening size of the opening 39 can be suppressed to the same height as the height of 2.8 mm in the opening size of a micro USB-B standard, for example, though it is a standard type. Accordingly, even in the chassis 16 having a curved cross-section in which the thickness of the side surface is smaller than that of the central portion, for example, as illustrated in FIGS. 8A and 8B, it is possible to prevent the vicinity of the opening 39 from being thicker than the other portions by using the receptacle 14. That is, since the structure of the receptacle 14 can be decreased in thickness, it is possible to increase the number of types on which the receptacle 14 can be mounted and thus to obtain high universality.

In the receptacle 14, the female-side plate-like member 36 moves to the sinking position which is sunk from the outer surface 16*a* of the chassis 16 when the connected state of the plug 12 is released. Accordingly, when the receptacle 14 is not used, the female-side plate-like member 36 can be received in the chassis 16 and the female-side plate-like member 36 does not protrude to the outside. Accordingly, it is possible to prevent the female-side plate-like member 36 from interfering or being destroyed at the time of transporting the electronic apparatus 10 or the like.

By employing the operation member 48 (push-button portion 74) that is exposed from the outer surface 16*a* of the chassis 16 and that causes the female-side plate-like member 36 to move from the sinking position to the protruding position, it is possible to cause the female-side plate-like member 36 to smoothly protrude for use in connection to the plug 12, which provides high convenience.

In this case, the receptacle 14 only has to include the tension spring 44 that impelling the female-side plate-like member 36 in the direction from the protruding position to the sinking position and the locking member 52 that locks the female-side plate-like member 36 to the protruding position against the impelling force of the tension spring 44 when the operation member 48 is operated to cause the female-side plate-like member 36 to move to the protruding position and that is pressed by the plug 12 to unlock the female-side plate-like member 36 at the protruding position when the plug 12 is connected thereto. Then, since the female-side plate-like member 36 can be satisfactorily kept at the protruding position, it is possible to smoothly connect the plug 12 and to automatically receive the female-side plate-like member 36 in the chassis 16 when the plug 12 is pulled out of the receptacle 14, which provides higher convenience.

The connection structure according to this embodiment is a connection structure in the USB connection standard between the plug 12 in which the male-side plate-like member 28 having the signal terminals 26 disposed therein is received in the metal case 30 and the receptacle 14 including the female-side plate-like member 36 having the signal terminals 34 disposed therein, in which the plug 12 is connected to the female-side plate-like member 36 protruding from the outer surface 16*a* of the chassis 16 of the electronic apparatus 10 having the receptacle 14 installed therein.

In this way, by employing the configuration in which the plug 12 is connected to the female-side plate-like member 36 of the receptacle 14 protruding from the outer surface 16*a* of the chassis 16, it is not necessary to provide the chassis 16 with the opening having an outer shape into which the metal case 30 of the plug 12 can be inserted even in the connection structure of the USB connection standard. Accordingly, it is to possible to decrease the thickness of the structure of the receptacle 14 as much as possible, to decrease the thickness of the chassis 16 of the electronic apparatus 10 on which the receptacle 14 is mounted, and thus to secure a degree of freedom in design of the chassis 16.

As has been described, the present disclosure provides a receptacle having a female-side plate-like member that is used for receiving a plug having a male-side plate-like member.

While the disclosure has been particularly shown and described with reference to a preferred embodiment, it will be understood by those skilled in the art that various changes in form and detail may be made therein without departing from the spirit and scope of the disclosure.

What is claimed is:

1. A receptacle comprising:

a female-side plate-like member having a signal terminal disposed therein; and a slider for controlling a position of said female-side plate-like member in relation to an outer surface of a chassis of an electronic device in which said receptacle is installed, wherein said female-side plate-like member is positioned to protrude from said outer surface of said chassis when ready to receive a plug having a male-side plate-like member on which a signal terminal is disposed, and is positioned to conceal from said outer surface of said chassis when not ready to receive said plug.

2. The receptacle of claim 1, wherein said slider is connected to an elastic member.

3. The receptacle of claim 1, wherein said slider is provided with a locking member having a hook.

4. The receptacle of claim 1, wherein said female-side plate-like member includes a slanted edge.

5. The receptacle of claim 4, wherein said slider include a slanted edge for sliding against said slanted edge of said female-side plate-like member.

6. The receptacle of claim 1, wherein said receptacle is compliant with a USB-A standard.

7. The receptacle of claim 6, wherein said plug is compliant with a USB-B standard.

8. The receptacle of claim 1, wherein said female-side plate-like member is connected to an elastic member.

9. The receptacle of claim 8, wherein said elastic member connected to said female-side plate-like member is not extended when said female-side plate-like member is positioned to conceal from said outer surface of said chassis.

10. The receptacle of claim 9, wherein said elastic member connected to said female-side plate-like member is extended when said female-side plate-like member is positioned to protrude from said outer surface of said chassis.

11. An electronic device comprising:

a chassis; and a receptacle contained within said chassis, wherein said receptacle includes a female-side plate-like member having a signal terminal disposed therein; and a slider for controlling a position of said female-side plate-like member in relation to an outer surface of said chassis in which said receptacle is installed, wherein said female-side plate-like member is positioned to protrude from said outer surface of said chassis when ready to receive a plug having a male-side plate-like member on which a signal terminal is disposed, and is positioned to conceal from said outer surface of said chassis when not ready to receive said plug.

12. The electronic device of claim 11, wherein said slider is connected to an elastic member.

13. The electronic device of claim 11, wherein said slider is provided with a locking member having a hook.

14. The electronic device of claim 11, wherein said female-side plate-like member includes a slanted edge.

15. The electronic device of claim 14, wherein said slider include a slanted edge for sliding against said slanted edge of said female-side plate-like member.

16. The electronic device of claim 11, wherein said receptacle is compliant with a USB-A standard.

17. The electronic device of claim 16, wherein said plug is compliant with a USB-B standard.

18. The electronic device of claim 11, wherein said female-side plate-like member is connected to an elastic member.

19. The electronic device of claim 18, wherein said elastic member connected to said female-side plate-like member is not extended when said female-side plate-like member is positioned to conceal from said outer surface of said chassis.

20. The electronic device of claim 19, wherein said elastic member connected to said female-side plate-like member is extended when said female-side plate-like member is positioned to protrude from said outer surface of said chassis.

* * * * *